US008298382B2

(12) United States Patent
Hanlon et al.

(10) Patent No.: US 8,298,382 B2
(45) Date of Patent: Oct. 30, 2012

(54) APPARATUS FOR USE WITH METALLIC STRUCTURES

(75) Inventors: Jason Hanlon, Bristol (GB); Thomas Josef McGee, Cincinnati, OH (US)

(73) Assignee: Abriox Limited, Newport, South Wales (GB)

( * ) Notice: Subject to any disclaimer, the term of this patent is extended or adjusted under 35 U.S.C. 154(b) by 175 days.

(21) Appl. No.: 12/969,197

(22) Filed: Dec. 15, 2010

(65) Prior Publication Data

US 2012/0152733 A1 Jun. 21, 2012

(51) Int. Cl.
*C23F 13/20* (2006.01)
*C23F 13/22* (2006.01)

(52) U.S. Cl. ..... 204/196.37; 204/196.01; 204/196.02; 204/196.04; 204/196.1; 204/196.26; 205/740; 205/734; 205/730; 205/726; 205/725; 205/724

(58) Field of Classification Search ..... 204/196.01, 204/196.02, 196.04, 196.1, 196.26, 196.37; 205/724, 725, 726, 730, 734, 740
See application file for complete search history.

(56) References Cited

U.S. PATENT DOCUMENTS

| | | | | |
|---|---|---|---|---|
| 3,860,912 | A * | 1/1975 | Romans | 340/870.18 |
| 4,356,444 | A | 10/1982 | Saenz, Jr. | |
| 4,387,337 | A | 6/1983 | Beeman | |
| 4,542,344 | A | 9/1985 | Darilek et al. | |
| 5,077,486 | A | 12/1991 | Marson et al. | |
| 5,471,143 | A | 11/1995 | Doany | |
| 6,127,827 | A | 10/2000 | Lewis | |
| 6,224,742 | B1 * | 5/2001 | Doniguian | 205/724 |
| 6,469,918 | B1 * | 10/2002 | Abramski | 363/45 |
| 6,498,568 | B1 * | 12/2002 | Austin et al. | 340/854.5 |
| 6,617,855 | B2 * | 9/2003 | Flatt et al. | 324/326 |
| RE38,581 | E * | 9/2004 | Doniguian | 205/724 |
| 6,954,071 | B2 * | 10/2005 | Flatt et al. | 324/326 |
| 2001/0047247 | A1 * | 11/2001 | Flatt et al. | 702/64 |
| 2002/0196008 | A1 | 12/2002 | Hilleary | |
| 2006/0070871 | A1 * | 4/2006 | Bushman et al. | 204/196.01 |
| 2009/0078585 | A1 * | 3/2009 | Dwars et al. | 205/724 |

FOREIGN PATENT DOCUMENTS

GB 2361069 A 10/2001

* cited by examiner

*Primary Examiner* — Bruce Bell
(74) *Attorney, Agent, or Firm* — Gifford, Krass, Sprinkle, Anderson & Citkowski, P.C.

(57) ABSTRACT

Apparatus for connection to a metallic structure, the apparatus comprises a transformer rectifier unit operable to output a DC current for cathodic protection of a metallic structure, and a modulator unit connected to receive a DC output from the transformer rectifier unit. The modulator unit is arranged for connection to a metallic structure, and is operable to produce a modulated current which is applied to such a metallic structure when the apparatus is in use, such that the metallic structure is detectable by a wireless locating device. The modulator unit is operable to be controlled remotely.

31 Claims, 3 Drawing Sheets

APPARATUS FOR USE WITH METALLIC STRUCTURES

BACKGROUND TO THE INVENTION

The present invention relates to apparatus for use with metallic structures. In particular, the present invention relates to apparatus, for use with metallic structures such as pipes, which facilitates corrosion protection and detection of structure location.

Metallic structures, such as pipes, cables and storage tanks which are buried underground are exposed to conditions which can promote corrosion of the structure. To try and minimise environmental damage to these structures, various methods of minimising corrosion have been developed. In particular, it is well known to use the technique of cathodic protection to reduce the occurrence of corrosion in such metallic structures.

To apply cathodic protection to a metallic structure, a protection system is used. An example of a pipe 12 provided with a known protection system 10 is shown in FIG. 1 of the accompanying drawings. The protection system 10 of FIG. 1 is an impressed current cathodic protection (ICCP) system in which an anode 14 which is external to the structure 12 is connected to a Transformer Rectifier unit 16. The Transformer Rectifier unit 16 is also connected with the structure 12, and applies a DC voltage (and hence a DC current) across the anode and the structure, so that the structure is at a negative potential with respect to the anode 14. Corrosion of the structure is reduced by virtue of the fact that the anode 14, the Transformer Rectifier unit 16 and the structure 12 form an electrochemical cell. The DC current that flows serves to reduce or stop corrosive anodic reactions occurring on the surface of the metallic structure 12. Such ICCP systems are well known.

It is well know that the protection application system can be provided with a feature which enables the DC cathodic protection current being applied to the structure to be switched on and off. By switching the DC current on and off in a controlled manner an identifiable pattern of interruptions in the current flow will be generated. The interruption of the DC current is performed using equipment such as an Interrupter device, relay or switch.

The interrupted DC current pattern can be used in various ways, for example, an interrupted DC current pattern can be used to determine the effectiveness of the cathodic protection by applying the interrupted signal to the structure, in this case a pipe. A measurement device is then connected directly to the pipe at a desired point along the pipe and potential measurements are taken with the current both on and off. These measurements are then repeated at other desired points along the pipe. The measurements are then used to determine that the normally applied cathodic protection current is at an acceptable level to prevent corrosion.

In addition, an interrupted DC current being applied to a pipe can be used to identify specific pipelines or the area of influence of a particular protection application system by making a connection to the pipe at a desired location and using a meter to measure the voltage and current patterns at that location. These measurements can then be analysed with reference to the applied interrupted DC current pattern to verify that the current is reaching the measurement point. For example, an Interrupter device could be set to apply a signal having a pattern of 1 second off and 4 seconds on. If a technician then connects a measurement device such as a voltmeter to a point on the pipeline and observes a change in potential consistent with this pattern then he knows that he is connected to the correct pipe and also that the protection application system does have an influence at this location.

An interrupted DC current can also be used to locate coating defects on the pipe by inserting detection probes into the soil above the pipe and measuring the current flowing in the soil. The absolute value of the current flowing in the soil is of little value but if the pattern matches that of the applied interrupted DC signal, the magnitude of the change (from on to off or vice versa) indicates the magnitude of the coating defect.

Remote monitoring and control of cathodic protection levels applied to structures, such as pipelines, is well documented and this can be performed using either wired connection methods, such as telephone lines or a computer network, or wireless connection methods such as radio, cellular modem or satellite communication.

To carry out the analysis of the area of protection on of an application system, or establish the location of a suspected default, it is necessary to know the actual location of the subterranean structure. Similarly, construction workers or mining and quarrying workers must know the exact location of buried structures such as pipes or cables to avoid causing accidental damage during excavation work. However, maps of underground pipes and cables are not always available or accurate. In view of this, a technique of locating and subsequently mapping underground structures by applying an AC signal to them and then using an electromagnetic system, in this case a pipe locator, to determine the physical location of the underground pipe has been developed. The AC signal is usually applied to the structure using a portable transmitter. To determine the location of a pipe, a portable transmitter is temporarily connected to the pipe either directly or by induction at a known location of the pipe. A pipe locator is then used to determine the pipe location in the surrounding area. However, the location of at least one local part of the pipe in the area must be known so that the portable transmitter can be connected with it to enable to remainder of the pipe location to be determined.

SUMMARY OF THE INVENTION

According to a first aspect of the present invention, there is provided an apparatus for connection to a transformer rectifier unit which is operable to output a DC current for cathodic protection of a metallic structure, the apparatus comprising: a modulator unit connected to receive a DC output from a transformer rectifier unit, and arranged for connection to a metallic structure, wherein the modulator unit is operable to produce a modulated current which is applied to such a metallic structure when the apparatus is in use, such that the metallic structure is detectable by a wireless locating device, and wherein the modulator unit is operable to be controlled remotely.

According to a second aspect of the invention there is provided apparatus for connection to a metallic structure, the apparatus comprising: a transformer rectifier unit operable to output a DC current for cathodic protection of a metallic structure; and a modulator unit connected to receive a DC output from the transformer rectifier unit, and arranged for connection to a metallic structure, wherein the modulator unit is operable to produce a modulated current which is applied to such a metallic structure when the apparatus is in use, such that the metallic structure is detectable by a wireless locating device, and wherein the modulator unit is operable to be controlled remotely.

Such a Remote Monitor Modulator is also operable to monitor operation of the Transformer Rectifier and cathodic protection system. Alarms and status reports may be sent wirelessly or via wired means to a control centre or monitoring station.

The resulting signal applied to the structure now contains both AC and DC components. It is able to provide cathodic protection to the metallic structure whilst the provision of the modulator unit, able to be controlled remotely, which introduces an AC signal, enables a remote locating device to be used to determine the location of the structure. By having the modulator unit operable to be controlled remotely means a request for an AC signal can be generated by a person whilst working in the field looking for the structure. The structure may be a pipe, storage tank, or any other kind of metallic structure.

The modulated current signal may have a modulation frequency of at least 1 Hz.

The modulator unit may be operable to be controlled remotely using a wireless controller. Preferably, the modulator unit may be operable to be controlled remotely using a mobile telephone.

Alternatively, the modulator unit is operable to be controlled remotely using a wide area network, local area network or internet connection.

Preferably, the modulated current signal is substantially a sine wave with a DC component.

Preferably, the modulator unit is further operable to generate an interruption to the DC current output from the transformer rectifier unit.

Such apparatus may further comprise a remote monitor unit operable to monitor operation of the transformer rectifier unit and such cathodic protection. The remote monitor unit may be operable to generate alarms and status reports relating to the transformer rectifier unit and such cathodic protection. The remote monitor unit may be operable to send such alarms and status reports wirelessly or via wired means to a control centre or monitoring station. The remote monitor unit may be integral with the modulator.

According to a third aspect of the invention there is provided a method of detecting a buried metallic pipe, the method comprising connecting a transformer rectifier unit to a buried metallic structure, supplying a DC current to the metallic structure to provide cathodic protection for the structure, modulating the DC current to provide a modulated current, and detecting the modulated current using a wireless locating device. In such a method the modulated DC current can have a modulation frequency of less than 1 Hz. According to an example, the modulated current has a modulation frequency of at least 1 Hz.

Such a method may be controlled remotely using a wide area network, local area network or internet connection.

Such a method may be controlled remotely using a wireless controller. The wireless controller may be a mobile telephone.

Such a method may further comprise remotely monitoring operation of the transformer rectifier unit. Such a method may further comprise generating alarms and status reports relating to the transformer rectifier unit and such cathodic protection. Such a method may further comprise sending such alarms and status reports wirelessly or via wired means to a control centre or monitoring station.

BRIEF DESCRIPTION OF THE DRAWINGS

An embodiment of the invention will now be described, by way of example only, and with reference to the accompanying drawings, in which.

DETAILED DESCRIPTION OF THE INVENTION

Figure 1:
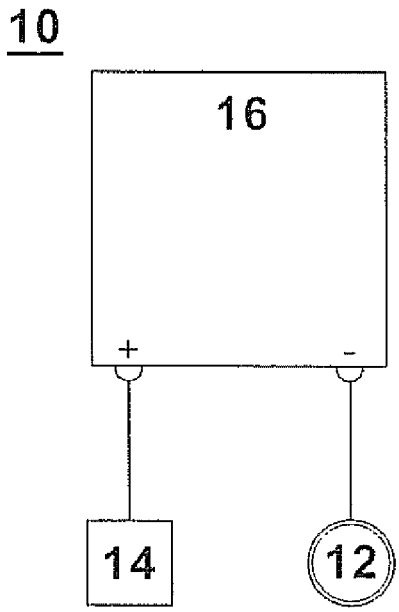
FIG. 1 illustrates a pipe provided with a known protection application system.
Figure 2:
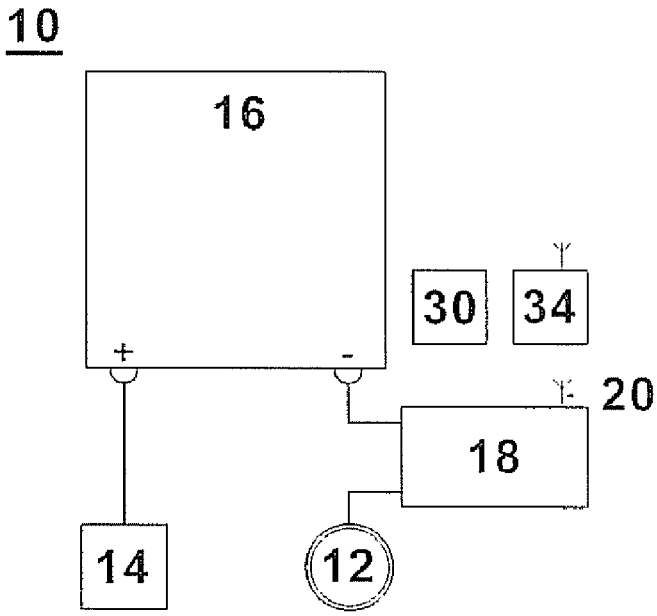
FIG. 2 illustrates a pipe provided with first embodiment of apparatus in accordance with the present invention.

FIG. 2 shows apparatus, which in this case is protection application apparatus 10, connected to a metallic pipe 12. The apparatus 10 comprises an anode 14 which in this case a ground bed, a Transformer Rectifier unit 16 and a modulator unit 18 which in this case is a remote monitor modulator unit provided with a wireless antenna 20. The anode 14 is connected to the Transformer Rectifier unit 16 which in turn is connected to the modulator unit 18 which is in turn connected to pipe 12. The Transformer Rectifier unit 16 is operable to output a DC current which, when applied to the pipe 12 via modulator unit 18 without modulation, provides cathodic protection to metallic pipe 12. The modulator unit 18 is connected to receive the DC current output from the Transformer Rectifier unit 16 and can transmit this current directly to the pipe 12 without modulation. However, upon a reception of an appropriate command generated by a remote control unit 34 and received by wireless antenna 20, the modulator unit 18 is operable to modulate the DC current output and produce a composite output current which is applied to pipe 12. The modulated current, when applied to the pipe 12, results in an electromagnetic field that is radiated by the pipe that is locally detectable by locating device 30 which can therefore locate pipe 12. The remote control unit 34 is, in this case a wireless device such as a mobile phone.

The locating device 30 is in this case wirelessly operated and may be any suitable conventional cable and pipe locator.

The modulation of the DC current within modulator unit 18 may be performed using electronic means. However it will be appreciated that any suitable modulating system may be implemented including, but not limited to a mercury relay or an electromechanical relay.

Figure 4:
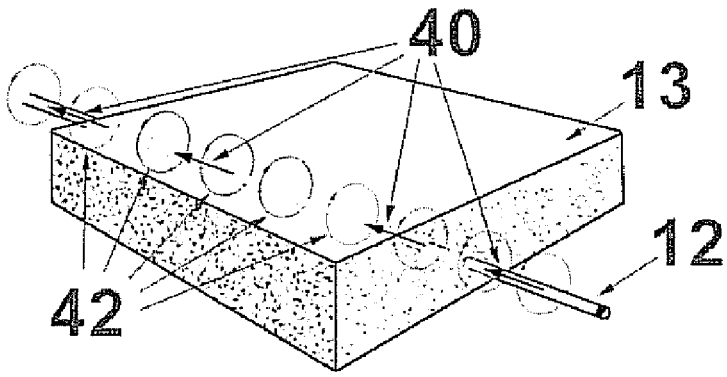
FIG. 4 illustrates a pipe provided with an AC current by apparatus of FIG. 2.

The modulation unit 10 modulates the output of the Transformer Rectifier 16 to generate an electromagnetic signal which is radiated from the pipe 12. As FIG. 4 shows, the modulated current 40 flows along the pipe. When modulated current 40 flows in the pipe 12, an electromagnetic field 42 is created which emanates from pipe 12. Despite the pipe 12 being buried in ground 13, the electromagnetic field 42 can be located by a suitable locating device (not shown). Typically the frequency of the modified signal will be 512 Hz or 640 Hz but could be any frequency from 1 Hz upwards. According to an example, a frequency which does not suffer from interference from other electromagnetic fields already present (for example from 60 Hz AC electrical supplies) can be selected. In the example that the frequency of the modified signal is less than or of the order of 1 Hz, a static set of magnetometers for example can be used to determine the presence of a metallic structure such as a pipe. The modulator unit 18 can also act upon the DC current output by the Transformer Rectifier unit 16 to cause the DC current to be interrupted. In this case, an interrupted DC signal will be applied to the pipe 12 enabling assessment of the level of cathodic protection being applied, the pinpointing of coating defects, faults and identification of specific structures.

Figure 5:
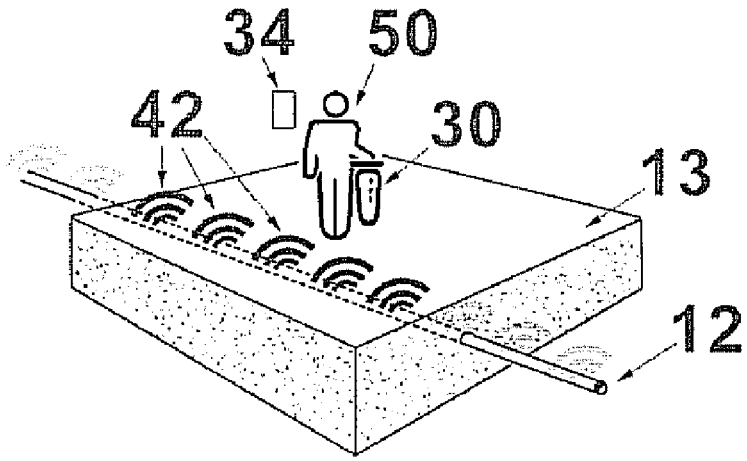
FIG. 5 illustrates a technician detecting a pipe provided with an AC current by apparatus of FIG. 2.

In use, the control of the modulation unit 18 is implemented by the remote control unit 34 thus the signal modulation can be implemented remotely. The remote control unit 34 is able determine if the modulation unit 18 is modulating the signal from the Transformer Rectifier unit 16 before application to the pipe 12 or if the signal from the Transformer Rectifier unit 16 is being applied without modulation to the pipe 12. The remote control unit 34 can further determine which frequencies of output signal the modulating unit 18 is generating. The remote control unit 34 can also generate command signals which cause the modulating unit 18 to switch the modulating function on or off. Upon remote control unit 34 generating a control signal which determines the modulation function be switched on; the modulator unit 18 will receive the command to modulate the signal output from the Transformer Rectifier unit 16 and generate a locating signal 40 to be applied to pipe 12. Thus, as can be seen in FIG. 5, a technician 50 in the field can then use the locating device 30 to physically locate pipe 12.

It will be appreciated that whilst the above embodiment details a technician using a locating device 30 to determine the location of pipe 12, the locating device 30 may be attached to equipment such as construction or excavation equipment (not shown). When the excavation equipment is in use and approaches a buried pipe, such as pipe 12, to which the locator device 30 is attuned the locating signal 42 would be detected and a proximity alarm would be generated or a virtual interlock activated to prevent construction or excavation equipment from accidentally excavating or damaging a buried metallic structure such as pipeline 12.

Figure 3:
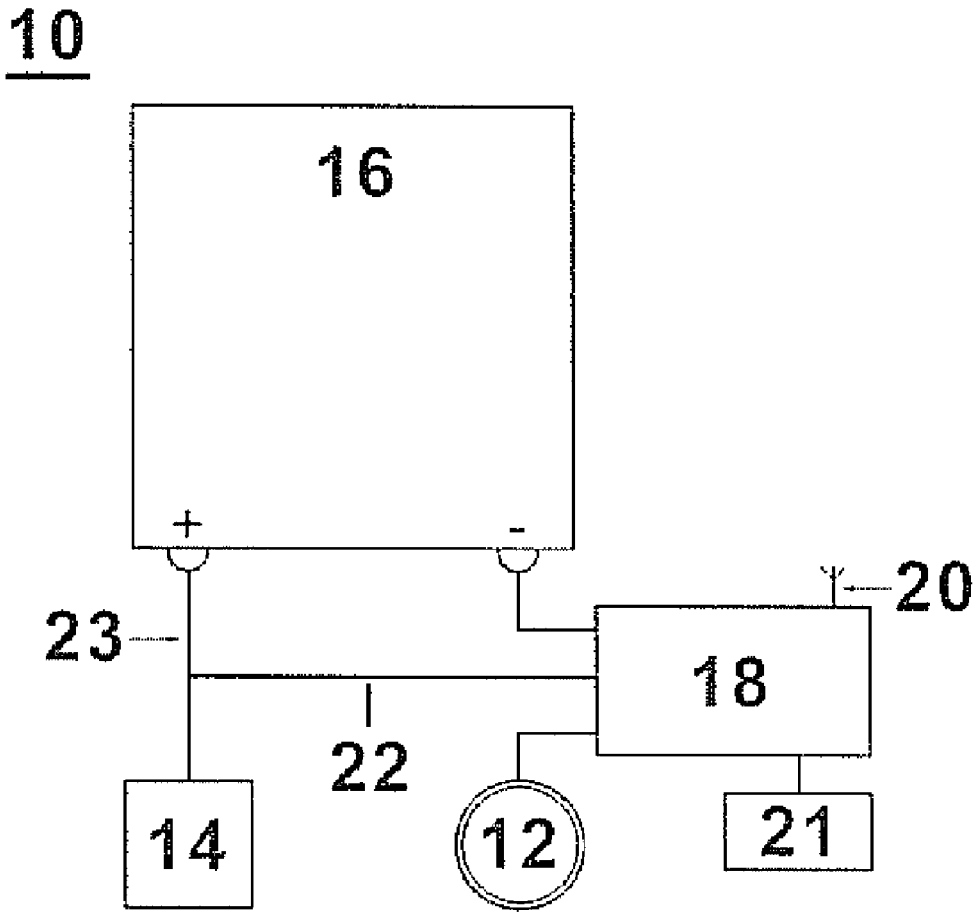
FIG. 3 illustrates a pipe provided with a second embodiment of apparatus accordance with the present invention.

In FIG. 3 there is shown a second embodiment of apparatus, which in this case is protection application apparatus 10, connected to a metallic pipe 12. The apparatus 10 comprises an anode 14, in this case a ground bed, a Transformer Rectifier unit 16, a modulator unit 18 which in this case is a remote monitor modulator unit provided with a wireless antenna 20 and a reference cell unit 21. The reference cell input allows the modulator unit 18 to monitor the cathodic protection level being applied to the metallic structure by the Transformer Rectifier source. The anode 14 is connected to the Transformer Rectifier unit 16 which in turn is connected to the modulator unit 18 which is connected to pipe 12 and reference cell 21. The modulator unit 18 is also provided with a connection 22 to the connection 23 between the Transformer Rectifier unit 16 and anode 14. In this embodiment, the connection 22 which connects the modulation unit 18 to connection 23 enables the modulation unit 18 to monitor output voltage of Transformer Rectifier unit 16. By monitoring the output voltage of Transformer Rectifier unit 16, the modulation unit 18 is able to determine whether the Transformer Rectifier unit 16 is functional and set at an appropriate level. Internally the modulation unit 18 may monitor the current flow to the pipe 12 from the Transformer Rectifier unit 16 to ensure that cathodic protection current is being applied and that the level is correct. As well as the protection application apparatus 10 functions detailed with reference to FIG. 3, the protection application apparatus 10 can be arranged so as to be used to monitor other parameters including, but not limited to the AC supply to the Transformer Rectifier, the cathodic protection potential of the pipe and other Transformer Rectifier outputs. In addition, the modulation unit 18 can be connected so that fewer parameters are be monitored, or no parameters may be monitored.

Although aspects of the invention have been described with reference to the embodiment shown in the accompanying drawings, it is to be understood that the invention is not limited to the precise embodiment shown and that various changes and modifications may be effected without further inventive skill and effort, for example, whilst the embodiments above have been described in relation to detecting a pipe 12, the apparatus 10 and associated locating technique may be used with any metallic structure including, but not limited to pipes, cables, support struts, containers and the like. In addition, the modulation of the DC signal within Remote Monitor Modulator 18 is described in the above embodiments as being implemented within a separate component 18 at the output of the Transformer Rectifier unit 16. However, the Remote Monitor Modulator 18 may be connected to the Transformer Rectifier unit 16 such that the signal modulation occurs at an internal intermediate stage within the Transformer Rectifier unit 16. Alternatively, the remote monitor modulator 18 may apply a control signal to the Transformer Rectifier 16 so that it modulates its own output in accordance with the control signal. Alternatively, the function of the Remote Monitor Modulator 18 may be incorporated partially or entirely into the Transformer Rectifier. In addition, in the above embodiments, the modulated signal 40 is ideally an AC signal having a sine wave format, however it will be appreciated that the modulation of the signal may be to form a sine wave or alternatively may form a square wave, or any suitable varying wave form which contains the frequency components that the pipe locator being used can detect. Furthermore, in the above embodiments the remote control unit 34 which generates a remote command to the modulation unit 18 has been described as a mobile phone. However, it will be appreciated that the remote control unit 34 may be any wireless electronic system such as a laptop or notebook. Alternatively the remote control unit 34 could utilise any suitable satellite communication system, internet connection or any other suitable wireless means. It will also be appreciated that the remote command could be issued by a remote control unit 34 located remotely from the technician, such as from an office managing the technician's workload, and so enable the technician, who is in the field, to locate or avoid the pipe.

The embodiments of the invention have been described with reference to protection and location of a buried metallic pipe for the sake of consistency, clarity and simplicity. However, it will be readily appreciated that the techniques described are applicable to any metallic structure, such as a pipe, storage tank or foundation that requires, or would benefit from, cathodic protection from corrosion.

The invention claimed is:

1. Apparatus for connection to a transformer rectifier unit which is operable to output a DC current for cathodic protection of a metallic structure, the apparatus comprising:

a modulator unit connected to receive a DC output from a transformer rectifier unit, and arranged for connection to a metallic structure, wherein the modulator unit is operable to produce a modulated current which is applied to such a metallic structure when the apparatus is in use, such that the metallic structure is detectable by a wireless locating device, and wherein the modulator unit is operable to be controlled remotely.

2. Apparatus as claimed in claim 1, wherein the modulated current has a modulation frequency of less than 1 Hz.

3. Apparatus as claimed in claim 1, wherein the modulator unit is operable to be controlled remotely using a wide area network, local area network or internet connection.

4. Apparatus as claimed in claim 1, wherein the modulator unit is operable to be controlled remotely using a wireless controller.

5. Apparatus as claimed in claim 1, wherein the modulator unit is operable to be controlled remotely using a mobile telephone.

6. Apparatus as claimed in claim 1, wherein the modulator unit is operable to generate an interruption pattern to the DC output from the transformer rectifier unit.

7. Apparatus as claimed in claim 1, further comprising a remote monitor unit operable to monitor operation of the transformer rectifier unit and such cathodic protection.

8. Apparatus as claimed in claim 7, wherein the remote monitor unit is operable to generate alarms and status reports relating to the transformer rectifier unit and such cathodic protection.

9. Apparatus as claimed in claim 8, wherein the remote monitor unit is operable to send such alarms and status reports wirelessly or via wired means to a control centre or monitoring station.

10. Apparatus as claimed in claim 7, wherein the remote monitor unit is integral with the modulator.

11. Apparatus as claimed in claim 1, wherein the modulated current has a modulation frequency of at least 1 Hz.

12. A method of detecting a buried metallic structure, the method comprising connecting a transformer rectifier unit to a buried metallic structure, supplying a DC current to the metallic structure to provide cathodic protection for the structure, modulating the DC current to provide a modulated current, and detecting the modulated DC current using a wireless locating device.

13. A method as claimed in claim 12, wherein the modulated DC current has a modulation frequency of less than 1 Hz.

14. A method as claimed in claim 12, being controlled remotely using a wide area network, local area network or internet connection.

15. A method as claimed in claim 12, being controlled remotely using a wireless controller.

16. A method as claimed in claim 15, wherein wireless controller is a mobile telephone.

17. A method as claimed in claim 12, further comprising remotely monitoring operation of the transformer rectifier unit.

18. A method as claimed in claim 17, further comprising generating alarms and status reports relating to the transformer rectifier unit and such cathodic protection.

19. A method as claimed in claim 18, further comprising sending such alarms and status reports wirelessly or via wired means to a control centre or monitoring station.

20. A method as claimed in claim 12, wherein the modulated current has a modulation frequency of at least 1 Hz.

21. Apparatus for connection to a metallic structure, the apparatus comprising:

a transformer rectifier unit operable to output a DC current for cathodic protection of a metallic structure;

a modulator unit connected to receive a DC output from the transformer rectifier unit, and arranged for connection to a metallic structure, wherein the modulator unit is operable to produce a modulated current which is applied to such a metallic structure when the apparatus is in use, such that the metallic structure is detectable by a wireless locating device, and wherein the modulator unit is operable to be controlled remotely.

22. Apparatus as claimed in claim 21, wherein the modulated current has a modulation frequency of less than 1 Hz.

23. Apparatus as claimed in claim 21, wherein the modulator unit is operable to be controlled remotely using a wide area network, local area network or internet connection.

24. Apparatus as claimed in claim 21, wherein the modulator unit is operable to be controlled remotely using a wireless controller.

25. Apparatus as claimed in claim 21, wherein the modulator unit is operable to be controlled remotely using a mobile telephone.

26. Apparatus as claimed in claim 21, wherein the modulator unit is operable to generate an interruption pattern to the DC output from the transformer rectifier unit.

27. Apparatus as claimed claim 21, further comprising a remote monitor unit operable to monitor operation of the transformer rectifier unit and such cathodic protection.

28. Apparatus as claimed in claim 27, wherein the remote monitor unit is operable to generate alarms and status reports relating to the transformer rectifier unit and such cathodic protection.

29. Apparatus as claimed in claim 28, wherein the remote monitor unit is operable to send such alarms and status reports wirelessly or via wired means to a control centre or monitoring station.

30. Apparatus as claimed in claim 27, wherein the remote monitor unit is integral with the modulator.

31. Apparatus as claimed in claim 21, wherein the modulated current has a modulation frequency of at least 1 Hz.

* * * * *